United States Patent [19]

Ferguson

[11] 4,092,776

[45] June 6, 1978

[54] CUTTING TOOL

[75] Inventor: William C. Ferguson, Denville, N.J.

[73] Assignee: Cooper Industries, Inc., Houston, Tex.

[21] Appl. No.: 861,291

[22] Filed: Dec. 16, 1977

[51] Int. Cl.[2] ..... B26B 13/18

[52] U.S. Cl. ..... 30/253

[58] Field of Search ..... 30/124, 134, 253, 261, 30/254

[56] References Cited

U.S. PATENT DOCUMENTS

| | | | |
|---|---|---|---|
| 1,186,235 | 6/1916 | Schrade | 30/261 X |
| 2,505,705 | 4/1950 | Cohn | 30/253 |
| 3,453,651 | 7/1969 | Wertepny | 30/254 |
| 3,453,731 | 7/1969 | Wertepny | 30/253 X |
| 3,608,196 | 9/1971 | Wiss | 30/253 |
| 3,659,343 | 5/1972 | Straus | 30/124 |
| 4,053,979 | 10/1977 | Tuthill | 30/124 |

FOREIGN PATENT DOCUMENTS

| | | | |
|---|---|---|---|
| 871,582 | 1/1942 | France | 30/253 |

*Primary Examiner*—Jimmy C. Peters
*Attorney, Agent, or Firm*—Jacobs & Jacobs

[57] ABSTRACT

A cutting tool comprising a one-piece plastic tongs having flat cutting blades disposed at the free ends thereof, the U-shaped portion of the tongs acting as a torsion spring to urge the blades into the proper cutting relationship as the legs of the tongs are moved together, the torsion spring portion being biased to urge the legs of the tongs to a normal fully open position and being loaded by distorting the U-shaped portion through relative movement of the legs from the normal fully open position to a latched position in which the cutting edges of the blades are exposed for cutting.

8 Claims, 11 Drawing Figures

FIG. 1
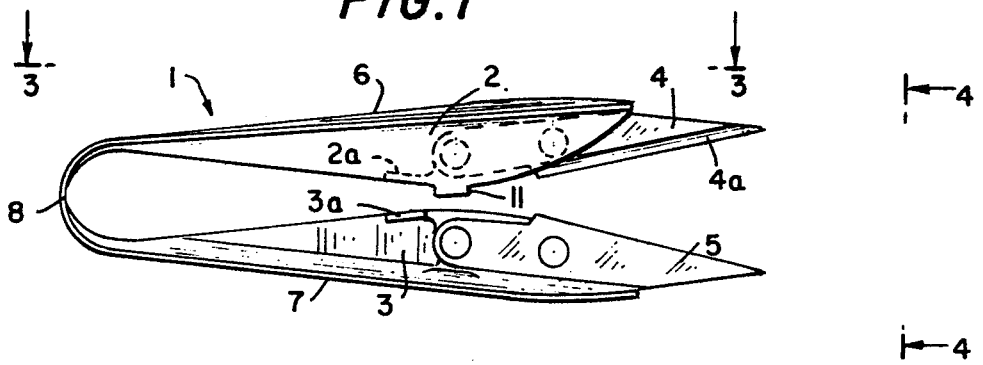
FIG. 2
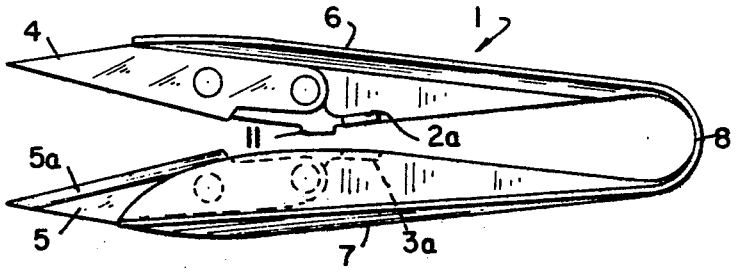
FIG. 3
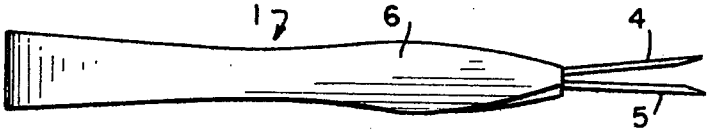
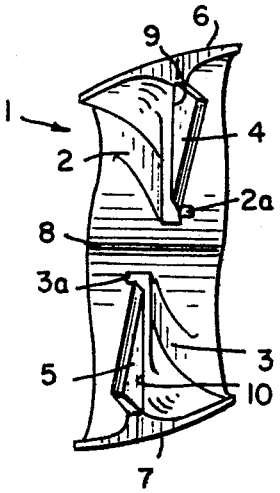
FIG. 4
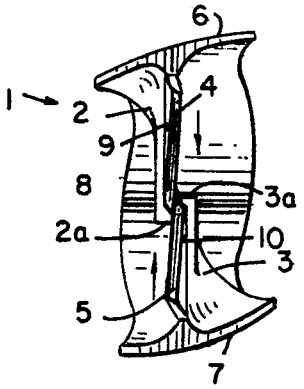
FIG. 8

FIG. 5
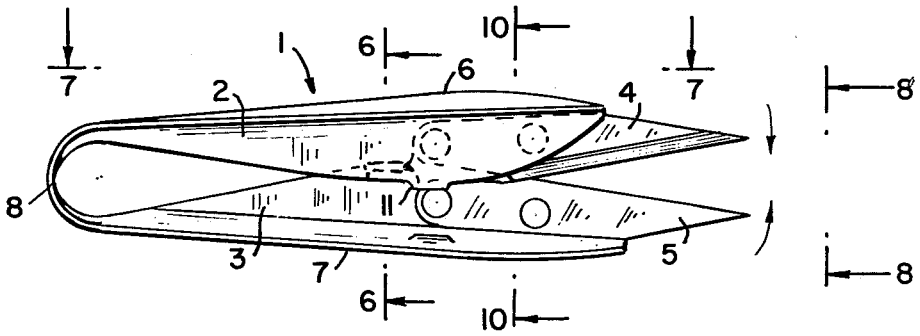
FIG. 10
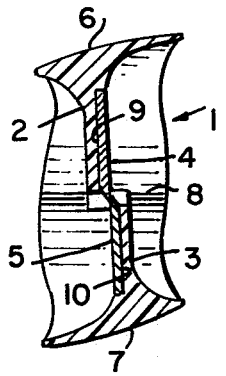
FIG. 6
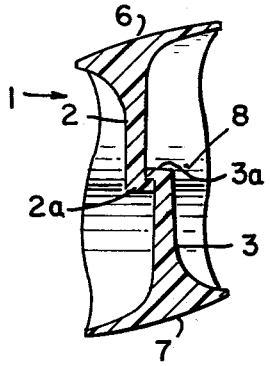
FIG. 11
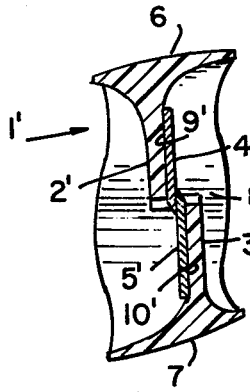
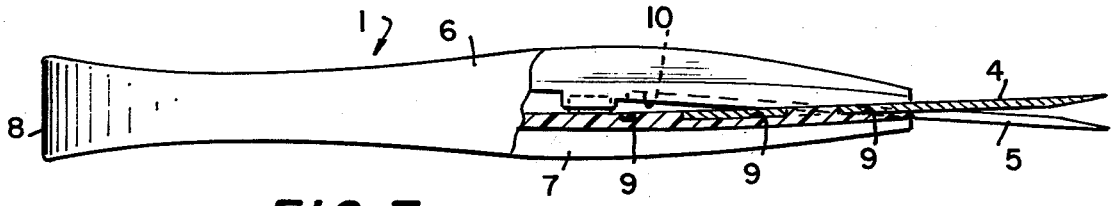
FIG. 7
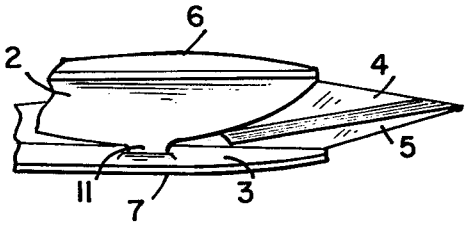
FIG. 9

CUTTING TOOL

The present invention relates to cutting tools and to their method of manufacture, and more particularly to thread cutters or clips, as well as scissors, shears and snips.

Blade-type cutting tools, such as scissors, snips, etc., employ a pair of cooperating blades that peform the cutting operation as the blades are closed together. Previously, the blades have been twisted and bowed to provide the required crossover and clearance angularity for the cutting operation. This is an expensive operation requiring skilled workers.

Cutting tools employing flat blades have been recently introduced. While highly successful, nevertheless these tools still require careful assembly, and the manufacturing costs, while reduced, nevertheless are desired to be reduced even further.

The present invention provides a cutting tool employing flat blades that reduce the tool to its ultimate simplicity. Only three pieces are required, a one-piece plastic body having integral legs and torsion spring, and a pair of flat blades carried by the legs. The present invention thus provides a significant step forward in the art.

In particular, the present invention provides a cutting tool, comprising:

(a) one-piece plastic tongs having a substantially U-shaped torsion spring portion and two integral leg portions extending therefrom and terminating in free ends, each said leg portion having a cutting blade mounting surface adjacent said free end;

(b) a pair of cooperating, flat, cutting blade members mounted on said cutting blade mounting surfaces and having a cutting surface projecting beyond said free ends, said cutting blade members being oppositely angularly disposed along their length and width with respect to one another as to provide crossover and clearance of said cutting surfaces for a cutting operation;

(c) disengageable stop means operable, when engaged, to limit relative movement of said legs;

(d) said tongs having a normal, fully open position in which said stop means is disengaged and said leg portions are urged by said torsion spring portion to their furthest separation, and second and third positions of lesser separation in which said stop means is engaged and said legs are in side-by-side relationship with said mounting surfaces facing one another, the cutting surfaces being exposed for cutting in said second position and not exposed in said third position, the blade members being operable to perform said cutting operation as the legs are moved together from said second position to said third position; and (e) said torsion spring portion being operable to apply torsion forces to said legs to urge said blade members together in cutting relationship as the cutting operation is performed and to return said tongs from said third position to said second position, said stop means, when engaged, stopping the returning legs at said second position.

Gutman U.S. Pat. No. 2,269,764 proposes a metal garden shears having a cylindrical metal spring connected to the ends of a pair of shanks, the free ends of the shanks carrying a pair of cutting blades. Also known in the prior art is the "Egyptian sheep shear", which is a one-piece shears formed by forging a U-shaped metal blank to form blades at the ends of the U. These metal shears require special forging or other working to bow and twist the blades such that, when the tool is disposed with the blades in a vertical plane the angle between the blades increases from the fulcrum or pivot to the forward ends thereof, and such that when the tool is viewed from the top and the blades are engaged near the fulcrum, the blades "cross-over", i.e. the forward ends of the blades overlap each other to an appreciable extent.

Wertepny U.S. Pat. Nos. 3,453,651, 3,524,363 and 3,608,196 provide a plastic cutting tool that eliminates the need to bow and twist the blades, and disclose a cutting tool having a pair of plastic arms pivoted at one end and having cutting blades mounted at the free ends thereof on mounting surfaces that are inclined along their length and width to provide the blades with the required cross-over and clearance angularity.

The present invention is a substantial improvement over the prior art. By providing a one-piece plastic body that has integral legs and torsion spring member, the need for a separate legs and spring member is eliminated. Further, the only assembly operation is the mounting of the blades on the legs, resulting in a substantial simplification of the manufacturing process. In addition, the tool uses ordinary flat blades, thus eliminating the need for bowing and twisting operations, since the plastic legs in cooperation with the plastic torsion spring member place the flat blades into the proper cutting relationship.

The present invention is illustrated in terms of preferred embodiments in the accompanying drawings, in which:

FIG. 1 is a view in elevation of one side of the cutting tool of the invention in its unlatched or disengaged position;

FIG. 2 is an elevational view of the other side of the cutting tool shown in FIG. 1;

FIG. 3 is a top plan view of the cutting tool taken along lines 3—3 of FIG. 1;

FIG. 4 is an end view of the cutting tool taken along lines 4—4 of FIG. 1;

FIG. 5 is a side elevational view of the cutting tool in its latched or engaged position;

FIG. 6 is a view in section taken along lines 6—6 in FIG. 5;

FIG. 7 is a top plan view, partly in section, taken along lines 7—7 in FIG. 5;

FIG. 8 is an end view taken along lines 8—8 in FIG. 5;

FIG. 9 is a detail view showing the cutting tool fully closed;

FIG. 10 is a view in section taken along lines 10—10 in FIG. 5; and

FIG. 11 is a detail view of another embodiment of the invention.

Referring now to FIG. 1 of the drawings, cutting tool 1 is shown as a thread snip or slip in the form of tongs having a pair of legs 2, 3, each having a cutting blade 4, 5 mounted thereon. Each leg 2, 3 has an integral finger pad 6, 7 to permit the user to operate the tool without contacting the blade directly with the fingers. Each leg 2, 3 and its finger pad 6, 7 is integral with a U-shaped torsion spring portion 8.

In its fully open position shown in FIGS. 1-4, and most clearly seen in FIGS. 3 and 4, blades 4 and 5 overlap or cross-over, so that the blades diverge from their back ends to their tips. Further, leg 2 is displaced from leg 3 (FIG. 4) so that the blades 4, 5 face away from one another. In the unlatched position shown in FIGS. 1–4, tool 1 cannot perform a cutting operation.

FIGS. 5–8 show the cutting tool in its latched position. Thus, leg 2 carries a stop or lug 2*a* and leg 3 has a complementary interlocking stop or lug 3*a*. To latch the tool, legs 2 and 3 are disposed horizontally and vertically toward one another, when viewed in FIGS. 4, 6 and 8, to interlock the underside of lug 3*a* with the top surface of lug 2*a*. In the latched position, the blades 4, 5 and their respective mounting surfaces 9, 10 face one another and the tool 1 is thus rendered operable for performing a cutting operation with the blades 4, 5 open and the cutting surfaces 4*a*, 5*a* exposed for cutting. Blades 4, 5 are mounted on oppositely inclined surfaces 9, 10 on legs 2, 3. Since blades 4, 5 are flat, the surfaces 9, 10 are inclined both along the length and width of each leg, in opposite hands, to provide the blades 4, 5 with the appropriate cross-over and clearance angularity. With reference to FIG. 7, blades 4 and 5 cross-over one another because surfaces 9 and 10 are each inclined along the length of their respective legs 2 and 3 in opposite directions. Thus, as shown in FIG. 7, surface 9 slopes upwardly to the right and surface 10 slopes downwardly to the right, along the length of blades 4 and 5, respectively. Further, as seen most clearly in FIG. 10, the clearance angularity is provided by inclination of surface 9 downwardly to the right and of surface 10 upwardly to the left.

Mounting surfaces 9 and 10 can be recessed, as shown in FIGS. 7 and 10, or they can be flush with or elevated above the surface of legs 2 and 3, as desired.

Blades 4 and 5 are permanently mounted on legs 2 and 3 by means of the studs 9 and 10 that fit into corresponding apertures in blades 4 and 5. The studs 9, 10 are heat welded to the blades 4, 5, and the apertures can have a slight countersink into which the heat welded material is displaced. The means for fastening the blades 4 and 5 to the legs 2 and 3 is not critical, and any other desired fastener, such as screws, can be used.

The desired clearance angularity and cross-over can be provided by the legs themselves by molding them to the proper surface characteristics. As shown in FIG. 11, the tool 1′ has legs 2′ and 3′ that are provided with as-molded surfaces 9′ and 10′, respectively, disposed at the desired angles in the horizontal and vertical planes so that flat blades 4′ and 5′ are at the same angular relationship as blades 4 and 5.

In all of the embodiments shown, torsion spring 8 exerts torsion forces on legs 2 and 3 (and 2′ and 3′) when the tool is latched, to rotate blade 4 clockwise and blade 5 counterclockwise (FIG. 10). These torsion forces act to urge the blades into proper cutting relationship during the cutting operation. Torsion spring 8 is loaded by distorting the torsion spring portion 8 from the normal fully open position (FIG. 4) to the latched position (FIG. 8). Since the latching operation requires horizontal movement of the upper leg 2 to the left and vertical movement downwardly, as viewed in FIGS. 4 and 8, relative to leg 3, the plastic torsion spring 8 will "store" an equal and opposite force acting to restore the leg 2 to its normal, unstressed position shown in FIG. 4.

The cutting operation is performed by manually moving the tool 1 from the latched position shown in FIGS. 5–8 to the closed position shown in FIG. 9. Stop 11 (FIG. 9) abuts legs 3 in the fully closed position to prevent overcutting. Legs 2 and 3 are returned to the latched position by the torsion spring portion 8. If the interlocking lugs 2*a* and 3*a* are disengaged, the torsion spring 8 will urge the legs 2, 3 apart to their widest separation while simultaneously swinging leg 2 over and across leg 3 to the position shown in FIG. 4.

The cutting tool according to the invention is readily fabricated from any desired plastic material that will impart the spring action to the torsion spring member. Suitable materials include acetals, nylons, polyolefins and the like. The acetal sold under the trademark "Delrin" is presently preferred. Any molding technique can be used, such as injection molding, thus imparting great flexibility in the fabrication techniques. The cutting tool according to the invention, by virtue of its simplicity of fabrication and absolute minimum of parts, lends itself to economies that were not heretofore realizable.

What is claimed is:

1. A cutting tool, comprising:

(a) one-piece plastic tongs having a substantially U-shaped torsion spring portion and two integral leg portions extending therefrom and terminating in free ends, each said leg portion having a cutting blade mounting surface adjacent said free end;

(b) a pair of cooperating, flat, cutting blade members mounted on said cutting blade mounting surfaces and having a cutting surface projecting beyond said free ends, said cutting blade members being oppositely angularly disposed along their length and width with respect to one another as to provide crossover and clearance of said cutting surfaces for a cutting operation; and (c) disengageable stop means operable, when engaged, to limit relative movement of said legs;

(d) said tongs having a normal, fully open position in which said stop means is disengaged and said leg portions are urged by said torsion spring portion to their furthest separation, and second and third positions of lesser separation in which said stop means is engaged and said legs are in side-by-side relationship with said mounting surfaces facing one another, the cutting surfaces being exposed for cutting in said second position and not exposed in said third position, the blade members being operable to perform said cutting operation as the legs are moved together from said second position to said third position; and (e) said torsion spring portion being operable to apply torsion forces to said legs to urge said blade members together in cutting relationship as the cutting operation is performed and to return said tongs from said third position to said second position, said stop means, when engaged, stopping the returning legs at said second position.

2. The cutting tool according to claim 1, wherein when said tool is disposed in the second position with one leg beneath the other and said stop means is disengaged, said torsion spring portion is biased to cause relative movement of the upper leg upwardly and across the lower leg so that the legs are separated both horizontally and vertically, and said torsion spring portion is loaded by being distorted as said legs are moved from said open position to said second position.

3. The cutting tool according to claim 1, wherein said stop means comprises a lug member on each said leg arranged to abut against each other when said tongs are in said second position.

4. The cutting tool according to claim 1, in which said cutting blade mounting surfaces are recessed in said legs.

5. The cutting tool according to claim 1, in which said cutting blade mounting surfaces are flush with the surface of said legs.

6. The cutting tool according to claim 1, in which one of said legs has a projection extending therefrom and arranged to contact a portion of the other leg to prevent relative movement of said legs beyond said third position after completion of said cutting operation.

7. The cutting blade according to claim 1, in which said legs each have a portion extending longitudinally and transversely thereof to provide finger-gripping portions protected from said blades.

8. The cutting tool according to claim 1, wherein said tongs are injection molded.

* * * * *

REEXAMINATION CERTIFICATE (81st)

United States Patent [19]

Ferguson

[11] B1 4,092,776

[45] Certificate Issued May 3, 1983

[54] CUTTING TOOL

[75] Inventor: William C. Ferguson, Denville, N.J.

[73] Assignee: Cooper Industries, Inc., Houston, Tex.

Reexamination Request

No. 90/000,007, Jul. 1, 1981

Reexamination Certificate for:

Patent No.: 4,092,776
Issued: Jun. 6, 1978
Appl. No.: 861,291
Filed: Dec. 16, 1977

[51] Int. Cl.[3] ..... B26B 13/18

[52] U.S. Cl. ..... 30/253

[58] Field of Search ..... 30/253

[56] References Cited

U.S. PATENT DOCUMENTS

| | | | |
|---|---|---|---|
| 45,198 | 11/1864 | Wendt | 30/234 |
| 250,629 | 12/1978 | Backstrom. | |
| 1,425,061 | 8/1922 | Sherman. | |
| 1,637,607 | 8/1927 | Eggers et al. | 30/234 |
| 1,913,958 | 6/1933 | Rieff | 30/235 |
| 2,269,764 | 8/1939 | Gotman. | |
| 3,972,333 | 8/1976 | Leveen | 128/318 |

FOREIGN PATENT DOCUMENTS

| | | |
|---|---|---|
| 16656134 | 3/1934 | Australia. |
| 43-1024 | 1/1968 | Japan. |
| 48-99999 | 1973 | Japan. |
| 49-12482 | 1974 | Japan. |
| 49-12483 | 1974 | Japan. |
| 49-12484 | 1974 | Japan. |
| 49-108187 | 1974 | Japan. |
| 50-15878 | 1975 | Japan. |
| 50-154592 | 1975 | Japan. |
| 419167 | 11/1934 | United Kingdom. |

OTHER PUBLICATIONS

Advertisement of SNIP SNIP Shears bearing a copyright date of 1972 and made for Chadwick Miller, Inc. of Boston, MA, made in Hong Kong.

Front Page of the Chadwick-Miller 1973 Catalog.

Page 23 of the Chadwick-Miller, Inc. 1973 Catalog. Describing Snip Shears 91378.

Copy of Advertisement of 91378 by Chadwick-Miller copyright 1972 of SNIP SHEARS.

*Primary Examiner*—Jimmy C. Peters

[57] ABSTRACT

A cutting tool comprising a one-piece plastic tongs having flat cutting blades disposed at the free ends thereof, the U-shaped portion of the tongs acting as a torsion spring to urge the blades into the proper cutting relationship as the legs of the tongs are moved together, the torsion spring portion being biased to urge the legs of the tongs to a normal fully open position and being loaded by distorting the U-shaped portion through relative movement of the legs from the normal fully open position to a latched position in which the cutting edges of the blades are exposed for cutting.

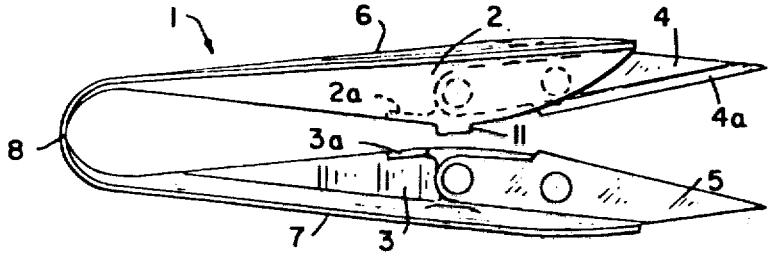

REEXAMINATION CERTIFICATE ISSUED UNDER 35 U.S.C. 307.

THE PATENT IS HEREBY AMENDED AS INDICATED BELOW.

Matter enclosed in heavy brackets appeared in the patent, but has been deleted and is no longer a part of the patent; matter printed in italics indicates additions made to the patent.

AS A RESULT OF REEXAMINATION, IT HAS BEEN DETERMINED THAT:

Claim 1 having been finally determined to be unpatentable is cancelled.

Claims 2–8 determined to be patentable as amended:

2. [The cutting tool according to claim 1,] *A cutting tool comprising:*

*(a) one-piece plastic tongs having a substantially U-shaped torsion spring portion and two integral leg portions extending therefrom and terminating in free ends, each said leg portion having a cutting blade mounting surface adjacent said free end;*

*(b) a pair of cooperating, flat, cutting blade members mounted on said cutting blade mounting surfaces and having a cutting surface projecting beyond said free ends, said cutting blade members being oppositely angularly disposed along their length and width with respect to one another as to provide crossover and clearance of said cutting surfaces for a cutting operation; and*

*(c) disengageable stop means operable, when engaged, to limit relative movement of said legs;*

*(d) said tongs having a normal, fully open position in which said stop means is disengaged and said leg portions are urged by said torsion spring portion to their furthest separation, and second and third positions of lesser separation in which said stop means is engaged and said legs are in side-by-side relationship with said mounting surfaces facing one another, the cutting surfaces being exposed for cutting in said second position and not exposed in said third position, the blade members being operable to perform said cutting operation as the legs are moved together from said second position to said third position; and*

*(e) said torsion spring portion being operable to apply torsion forces to said legs to urge said blade members together in cutting relationship as the cutting operation is performed and to return said tongs from said third position to said second position, said stop means, when engaged, stopping the returning legs at said second position* wherein when said tool is disposed in the second position with one leg beneath the other and said stop means is disengaged, said torsion spring portion is biased to cause relative movement of the upper leg upwardly and across the lower leg so that the legs are separated both horizontally and vertically, and said torsion spring portion is loaded by being distorted as said legs are moved from said open position to said second position.

3. The cutting tool according to claim [1] *2,* wherein said stop means comprises a lug member on each said leg arranged to abut against each other when said tongs are in said second position.

4. The cutting tool according to claim [1] *2,* in which said cutting blade mounting surfaces are recessed in said legs.

5. The cutting tool according to claim [1] *2,* in which said cutting blade mounting surfaces are flush with the surface of said legs.

6. The cutting tool according to claim [1] *2,* in which one of said legs has a projection extending therefrom and arranged to contact a portion of the other leg to prevent relative movement of said legs beyond said third position after completion of said cutting operation.

7. The cutting blade according to claim [1] *2,* in which said legs each have a portion extending longitudinally and transversely thereof to provide finger-gripping portions protected from said blades.

8. The cutting tool according to claim [1] *2,* wherein said tongs are injection molded.

* * * * *